US006213348B1

(12) United States Patent
Le Grouyellec

(10) Patent No.: US 6,213,348 B1
(45) Date of Patent: Apr. 10, 2001

(54) SYSTEM FOR THE PUMPING OF LIQUID

(76) Inventor: André Le Grouyellec, 11, Rue des Peupliers, 54600 Auray (FR)

( * ) Notice: Subject to any disclaimer, the term of this patent is extended or adjusted under 35 U.S.C. 154(b) by 0 days.

(21) Appl. No.: 09/219,094

(22) Filed: Dec. 22, 1998

(30) Foreign Application Priority Data

Dec. 31, 1997 (FR) ..... 97 16884
May 11, 1998 (FR) ..... 98 06130

(51) Int. Cl.[7] ..... B67D 5/08; G01F 11/28
(52) U.S. Cl. ..... 222/61; 222/64; 222/444
(58) Field of Search ..... 222/61, 64, 425, 222/442, 444, 450

(56) References Cited

U.S. PATENT DOCUMENTS 4,274,552 * 6/1981 Proni ..... 222/61
4,921,134 * 5/1990 Aschberger et al. ..... 222/64
5,294,023 * 3/1994 Ioannides et al. ..... 222/61
5,480,063 * 1/1996 Keyes et al. ..... 222/64
5,568,882 * 10/1996 Takacs ..... 222/61
5,680,960 * 10/1997 Keyes et al. ..... 222/64

* cited by examiner

*Primary Examiner*—Kevin Shaver
*Assistant Examiner*—David Deal
(74) *Attorney, Agent, or Firm*—Laff, Whitsel & Saret, Ltd.; J. Warren Whitesel

(57) ABSTRACT

A pumping system includes a chamber (10) having an intake orifice (11) for introducing liquid into said chamber (10). A discharge orifice (12) discharges the liquid from the chamber (10). Another orifice (13) receives pressurized gas. A valve is located at each of the orifices (11, 12, 13). The valves (15, 16, 17) are controlled in synchronization according to two phases. During the first phase the valve (15) opens at the intake orifice (11) while the other two valves (16 and 17) are closed, in order to fill the chamber (10). During a second phase the valve (15) associated with the intake orifice (11) is closed while the other two valves (16 and 17) are open, this enabling pressurized gas to be introduced into the chamber (10), thereby expelling the liquid in the chamber (10) through the discharge orifice (12).

8 Claims, 5 Drawing Sheets

SYSTEM FOR THE PUMPING OF LIQUID

The present invention concerns a liquid pumping system. Such a pumping system can work as a pump with various liquids. One application of such a pumping system can consist of a liquid gun, such as for water, which can project a liquid at a great distance and at a controllable rate, for example for watering plants or as a water cannon for use against fire or riots.

BACKGROUND OF THE INVENTION

In order to spray a liquid, use is generally made of centrifugal pumps which are coupled to a thermal engine. The drawback of such pumps is that they require a relatively high power. For example, a centrifugal pump which has an output of 1300 liters/minute at a pressure of 12 bar requires, for the thermal engine in which drives this, a power of 120 continental horsepower.

The aim of the invention is to propose a liquid pumping system which considerably reduces this power required for spraying said liquid, for example in a ratio of 8 to 10.

BRIEF SUMMARY OF INVENTION

To this end, a system for pumping a liquid according to the invention is characterised in that it consists of a chamber provided with an orifice for introducing, into the chamber, a liquid issuing from a source, an orifice for discharging the liquid out of the chamber and an orifice opposite to the orifice for discharging the liquid for introducing pressurised gas, each orifice being provided with a valve, the valves being controlled in a synchronized fashion according to two phases, a first so-called filling phase in which the valve associated with the introduction orifice is open whilst the other two valves are closed, thus enabling the chamber to be filled, and a second so-called expulsion phase in which the valve associated with introduction orifice is closed whilst the other two valves are open enabling pressurised gas to be introduced into the chamber through the introduction orifice, thus expelling the liquid contained in the chamber through the discharge orifice.

According to another characteristic of the invention, the chamber is provided with a vent opposite to the liquid introduction orifice, the vent itself being provided with a valve which opens and closes at the same time as the valve associated with the liquid introduction orifice.

According to another characteristic of the invention, alternative to the previous one, the chamber is provided with an orifice connected, via a valve, to a vacuum pump, the valve opening and closing at the same time as the valve associated with the liquid introduction orifice.

According to another characteristic of the invention, the valve associated with the introduction orifice is situated at the end of the chamber which is provided with the discharge orifice, the vent being situated at the other end.

According to another characteristic of the invention, it has means for detecting liquid levels in the said chamber, whose signals are supplied to a control unit designed to be able to control the opening and closing of the valves.

According to another characteristic of the invention, the chamber has, on the same side as its discharge orifice, a tapered part narrowing towards the discharge orifice.

The present invention also concerns a set of pumping system s in accordance with a pumping system as just described. According to the invention, it is characterised in that each system is controlled so that the discharge phases of each discharge system follow one after the other, and in that, whilst that of one system is current, filling phases are implemented in the other systems.

According to another characteristic of this set, the number n of discharge systems in the set is such that n times the discharge time correspond to a filling time.

BRIEF DESCRIPTION OF DRAWINGS

The characteristics of the invention mentioned above, as well as others, will emerge more clearly from a reading of the following description of an example embodiment, the description being given in relation to the accompanying drawings, amongst which.

DETAILED DESCRIPTION OF INVENTION

Figure 1:
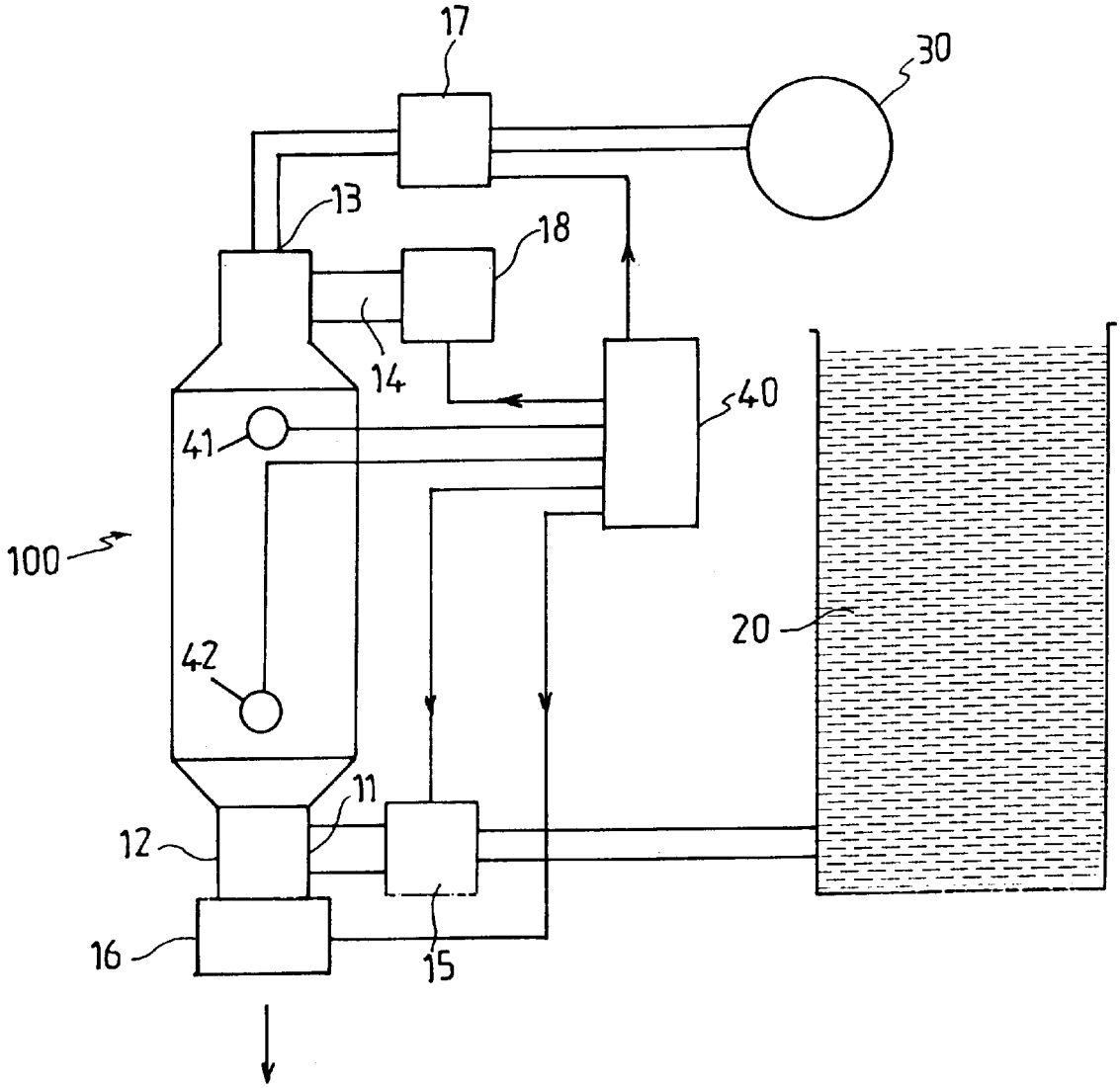
FIG. 1 is a diagram showing a water pumping installation using a pumping system according to the invention, FIG. 2 Is a diagram showing a water pumping installation using a pumping system according to a variant of the invention.

The installation depicted in FIG. 1 consists essentially of a pumping system according to the invention 100, a liquid source 20 and a compression pump 30 intended to supply a gas at a relatively high pressure. For example, this gas is air.

The pumping system 100 which can be seen in this FIG. 1 consists essentially of a body forming in its interior a closed chamber 10, for example but not necessarily cylindrical. The body 10 is provided with an orifice 11 intended for introducing liquid from the source 20 into the chamber of the body 10 and an orifice 12 for discharging, out of the chamber of the body 10, the liquid which it contains. In the example embodiment depicted, the introduction orifice 11 and a discharge orifice 12 are situated in the lower part of the body 10, which has a longitudinal axis which is vertical.

This body 10 is also provided with an orifice 13 which is opposite the orifice for discharging the said liquid 12 and which is designed to allow the introduction, into the chamber of the body 10, of the gas under high pressure supplied by the compression pump 30.

The body 10 is also provided with a vent 14 which is situated opposite the introduction orifice 12.

The pumping system 100 also has a valve 15 placed on the pipe between the source 20 and the introduction orifice 11, a valve 16 placed on the discharge orifice 12, a valve 17 placed on the pipe between the pump 30 and the introduction orifice 13 and a valve 18 placed on the vent 14.

The valves 15 to 18 are controlled in synchronism by means of a control unit 40 which also receives the signals on the one hand from a low-level detector 42 and on the other hand from a high-level detector 41.

The pumping system 100 according to the invention functions as follows.

In a first phase referred to as the filling phase, the chamber of the body 10 is filled with a volume of liquid issuing from the source 20. To do this, the introduction valve 15 and the valve of the vent 18 are opened, the gas introduction valve 13 and the discharge valve 16 for their part being closed. The liquid issuing from the source 20 enters by gravity into the chamber of the body 10, via the introduction orifice 11. Filling takes place until the liquid reaches the level of the high detector 41, which transmits a signal to the control unit 40, which triggers the closure of the valves 15 and 18.

It will be noted that the vent 14 serves for the discharge of the air which is driven from the chamber of the body 10 by its filling with liquid.

In a second phase, referred to as the discharge phase, the gas introduction valve 17 is open, as is the discharge valve 16. As a result, at the surface of the liquid which is opposite to the orifice 12 there is a gas pressure given by the pump 30 which has the effect of pressing on this surface and affording the discharge of the liquid through the orifice 12. The liquid is expelled and sprayed in the form of a high-power jet.

It should be noted that, according to a preferred mode, the second phase commences immediately after the end of the first phase. Consequently the valves 16 and 17 open as soon as the valves 15 and 18 close.

It should be noted that the opening of the valves 16 can be slightly delayed with respect to the opening of the valves 17.

When the liquid level corresponds to that of the low detector 42, a signal is transmitted to the control unit 40, which triggers the closure of the valves 16 and 17. The control unit 40 can then once again trigger the first phase of the process.

With such a system, the consumed power necessary for its functioning was around 11 continental horsepower whereas, in order to have the same performance with regard to pressure and output of the water jet obtained, a power of 120 continental horsepower is necessary with a centrifugal pump.

Figure 2:
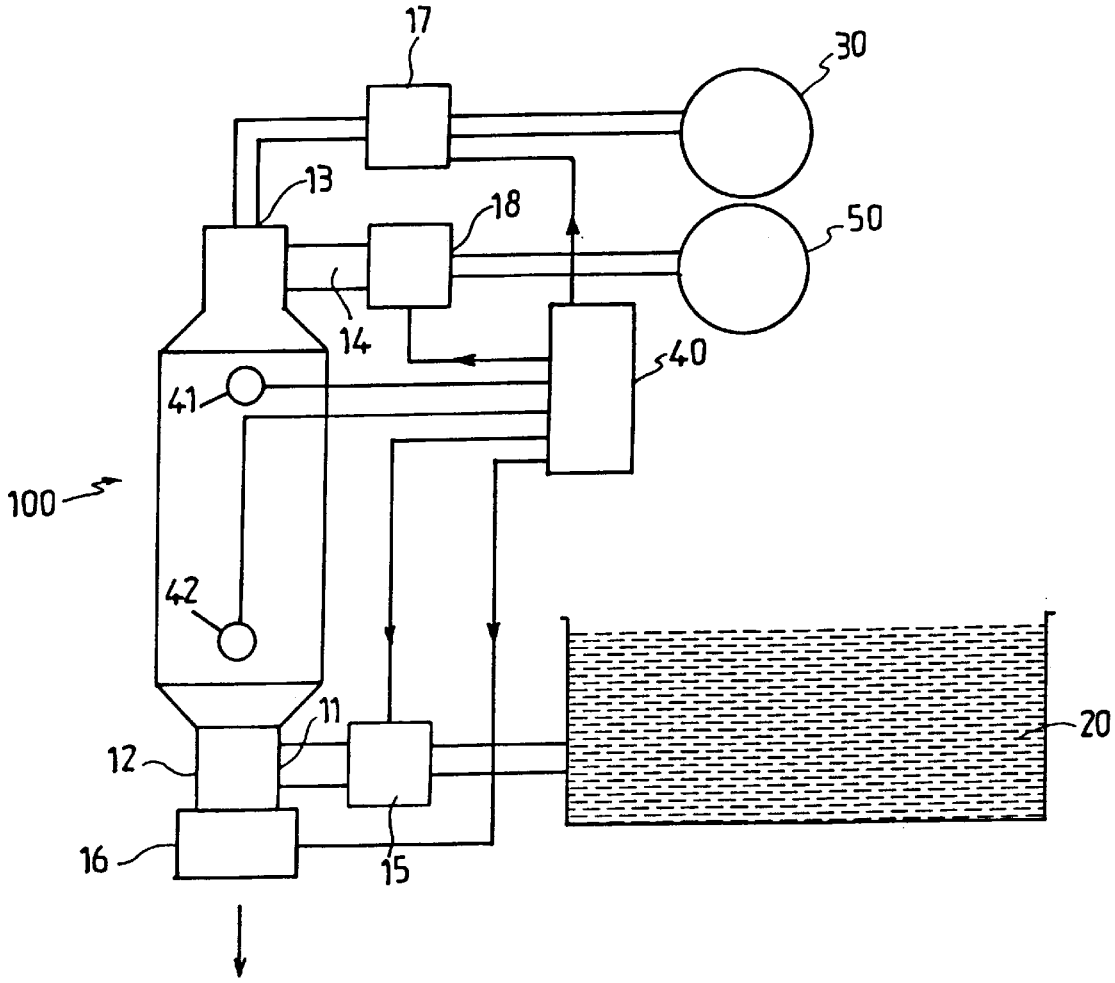

In the example embodiment in FIG. 2, the vent 14 is replaced by an orifice 14 connected, via the valve 18, to a suction pump 50. The functioning is similar to that of the example embodiment depicted in FIG. 1, except that the liquid from the source 20 is no longer introduced by gravity but by producing a vacuum in the chamber of the body 10 by means of the suction pump 50.

It should also be noted that the detectors 41 and 42 could be replaced by a pressure switch which, when the pressure in the body 10 reaches, whilst increasing, an upper limit valve, demands the closure of the valves 15 and 18 and which, when the pressure in the body 10 reaches, in falling, a lower limit value, demands the closure of the valves 16 and 17.

Figure 3:
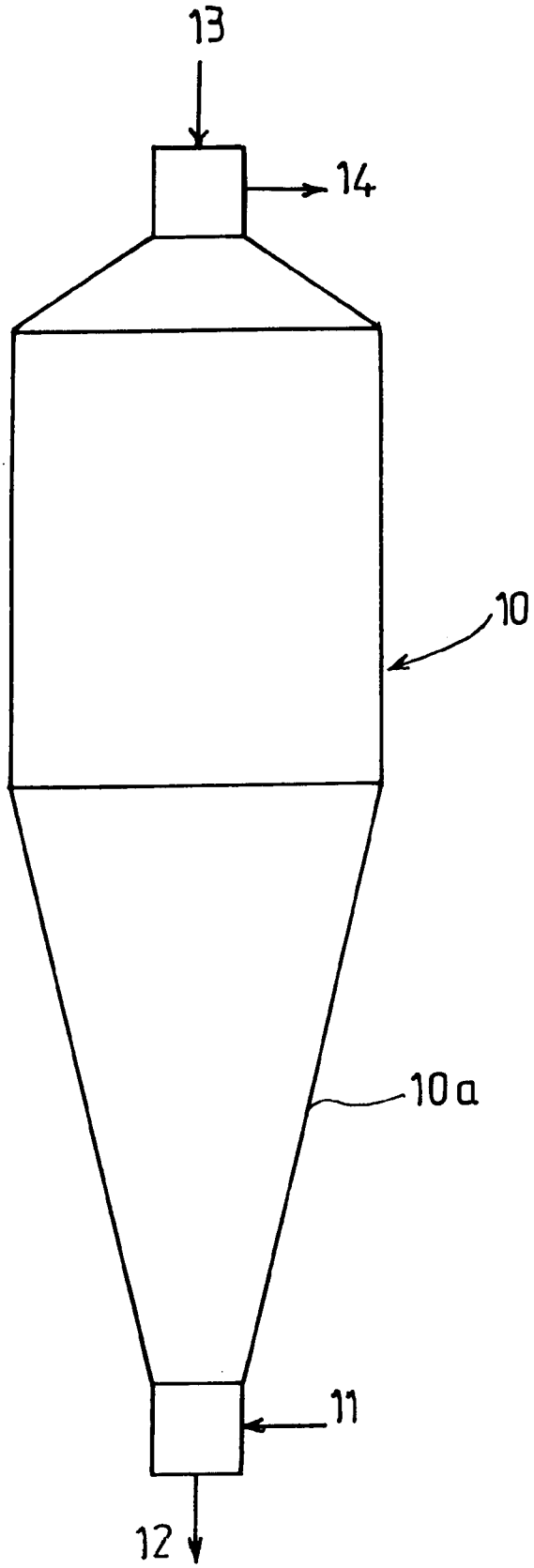
FIG. 3 shows a diagram of a body of a pumping system according to the invention in a particular embodiment.

FIG. 3 depicts a body 10 of a pumping system according to the invention with its introduction orifices 11 and 13 and its discharge orifice 12 a nd its vent (or suction orifice) 14. This body 10 has the particularity of comprising, in its lower part, a tapered part 10*a* narrowing towards the discharge orifice 12. It was possible to show that this characteristic was advantageous for obtaining a fine atomisation at the end of the jet because of the mixing of water and gas which takes place at the end of discharge.

Figure 4:
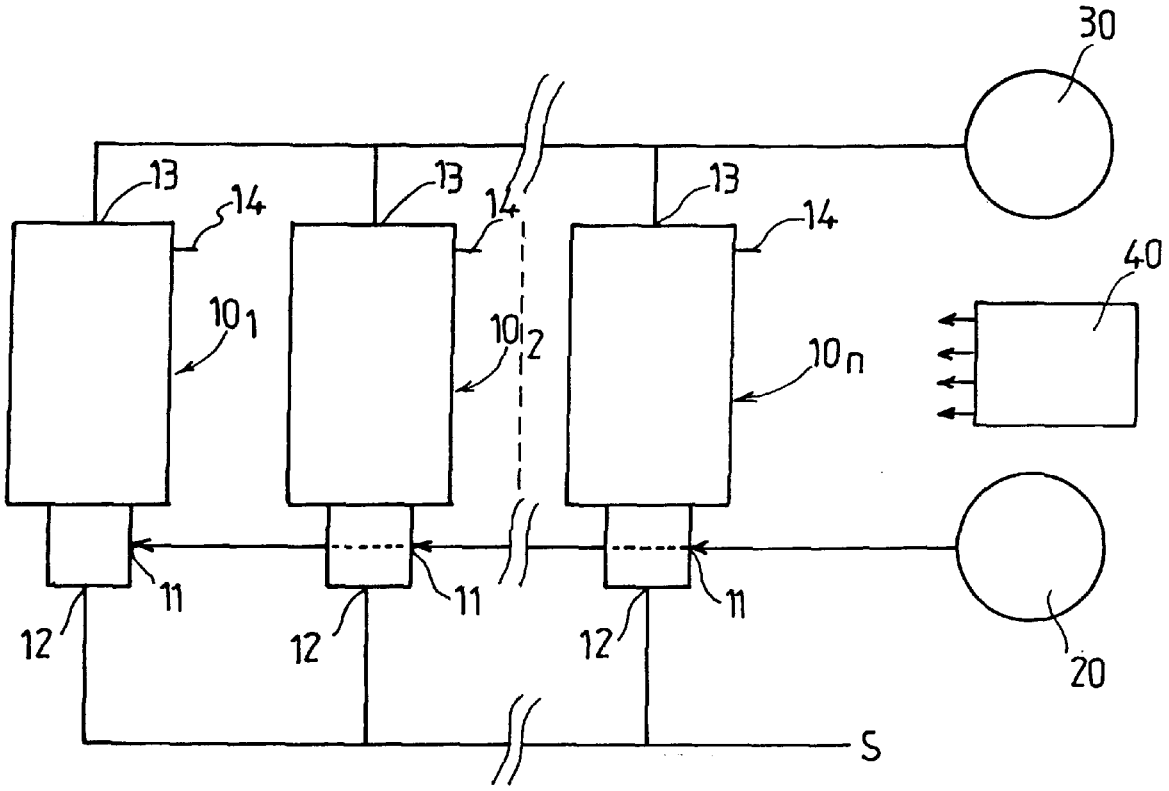
FIG. 4 is a diagram of a set of pumping systems according to the invention.

FIG. 4 depicts an installation with n pumping systems 101 to 10*n* identical to the first embodiment depicted in F ig 1. It should be noted however that the said systems could be identical to the second embodiment in FIG. 2. In this FIG. 4, the valves 15 to 18 of each system 101 to 10*n* have not been depicted for reasons of clarity in FIG. 4.

The source 20 is therefore connected to the n introduction inlets 11 of the n pumping systems 101 to 10*n*, via n respective valves 15 (see FIG. 1). Likewise, the compression pump 30 is connected to the n pressurised gas introduction inlets 13 of the n pumping systems 101 to 10*n*, via n respective valves 17 (see FIG. 1) and the n discharge orifices 12 are connected to an outlet S. The vents 14 should be noted, which are also connected to respective valves 18 (see FIG. 1).

Figure 5:
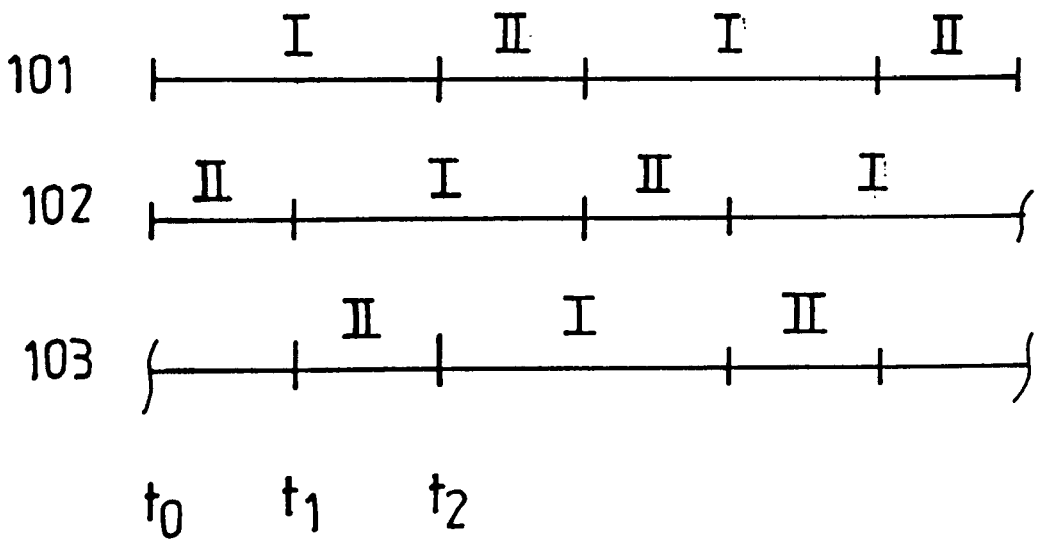
FIG. 5 is a diagram illustrating the functioning of a set in accordance with that of FIG. 4.

The control unit 40 controls each system 10*i* (i being able to vary from 1 to n) as indicated above, that is to say according to two phases, a filling phase I and a discharge phase II, phases which are triggered and interrupted after reception of the level signals issuing from the detectors 41 and 42 of each system 10*i*. FIG. 5 depicts how these phases I and II unfold over time for each pumping system of an installation which has three of them (n=3). It will be noted that, in this FIG. 5, that the duration of the filling phase I is greater than of the discharge phase II.

At time t0, the system 101 begins to fill, the system 102 discharges and the system 103 finishes filling. At time t1, the system 101 is still filling, the system 102 has finished discharging and is beginning to fill and the system 103 is beginning to discharge. At time t2, the system 101 finishes filling and begins to discharge, the system 102 is still filling and the system 103 has finished discharging and is beginning its filling.

It should be noted that the discharge phases II follow one after the other, and that, whilst that of one system is current, filling phases are implemented in the other systems. Advantageously, a number n of systems will be chosen such that n times the duration of the discharge phase II correspond to that of the filling phase I. This is because, in this case, the output at the outlet S is substantially constant.

What is claimed is:

1. A system for pumping a single liquid under a substantial pressure comprising a source (20) of liquid, a chamber (10) having a first orifice (11) for receiving liquid from said source, a vent (14) opening while said liquid is being received in said chamber, a second orifice (12) for discharging liquid from said chamber and from said system, said vent (14) closing while said liquids is being discharged from said chamber and from said system, a third orifice (13) opposite said second orifice for introducing pressurized gas into said chamber under said substantial pressure, valve means (15, 16, 17) at each orifice, control means for synchronizing said valves in two phases, a first of said phases being a fill phase with a first of said valves being open at the first orifice and with second and third of said valves closed at said second and third orifices, respectively, and a second of said phases being an emptying phase with said second and third valves open at said second and third orifices, respectively, and with said first valve at said first orifice closed, and discharge means for introducing pressurized gas under said substantial pressure through said third orifice during said second phase for forcing said liquid from said system responsive to said substantial pressure.

2. The system of claim 1, wherein said vent (14) is associated with a fourth valve (18) opposite said first orifice, and means for opening and closing said fourth valve in synchronism with the opening and closing of the first valve at said first orifice.

3. The system of claim 1 further comprising and a fourth orifice (14) and a vacuum pump (50) connected via a fifth valve (18), said first and fifth valves operating in sequence.

4. The system of any one of the claims 1–3, wherein said chamber has two ends, said first orifice, first valve, and said discharge orifice (12) are located at one end of said chamber, and said vent (14) is located at a second end of said chamber.

5. The system of any one of the claims 1–3, further comprising means (41, 42) for detecting a level of a liquid in said chamber, and means responsive to said detecting means for sending signals to said control means.

6. The system of claim 1 and means associated with said second orifice (12) for providing a tapered housing (10*a*) with a wide end at said chamber and extending to a narrow end at said second orifice.

7. The system of claim 1 wherein there are a plurality of said chambers ($10_1$, $10_2$ . . . $10_{11}$), and means responsive to said control means for discharging from one of said chambers while another of said chambers is filling.

8. The system of claim 1 wherein the duration of the fill phase is equal to the duration of the discharge phase multiplied by the number of said chambers.

* * * * *